US005129171A

United States Patent [19]

Arbter et al.

[11] Patent Number: 5,129,171

[45] Date of Patent: Jul. 14, 1992

[54] INFLATABLE OR TWISTABLE TUBES FOR EMBROIDERY HOOP FABRIC TENSIONING

[75] Inventors: Conrad Arbter, Saal/Saale; Rolf Mahling, Korbach, both of Fed. Rep. of Germany

[73] Assignee: PFAFF Industriemaschinen GmbH, Kaiserslautern, Fed. Rep. of Germany

[21] Appl. No.: 585,169

[22] PCT Filed: Apr. 18, 1989

[86] PCT No.: PCT/EP89/00415

§ 371 Date: Dec. 17, 1990

§ 102(e) Date: Dec. 17, 1990

[87] PCT Pub. No.: WO89/10443

PCT Pub. Date: Nov. 2, 1989

[30] Foreign Application Priority Data

Apr. 19, 1988 [DE] Fed. Rep. of Germany ..... 3813016
Dec. 21, 1988 [DE] Fed. Rep. of Germany ..... 3843000

[51] Int. Cl.[5] ..... D05C 1/04

[52] U.S. Cl. ..... 38/102.2; 38/102.91; 112/103; 160/380; 160/395

[58] Field of Search ..... 38/69, 70, 1 R, 102, 38/102.1, 102.2, 102.9, 102.91; 112/103, 121.12; 160/329, 378, 380, 382, 395, 399, 380, 392, 391; 101/127.1, 415.1

[56] References Cited

U.S. PATENT DOCUMENTS

| | | | |
|---|---|---|---|
| 380,550 | 4/1888 | Clowes | 38/102.1 |
| 998,657 | 7/1911 | Thomas | 38/102.2 |
| 1,056,966 | 3/1913 | Belding | 38/102.2 |
| 1,078,809 | 11/1913 | Thomas | 38/102.2 |
| 1,357,737 | 11/1920 | Solaini | 38/102.2 |
| 2,779,053 | 1/1957 | Longstreth et al. | 38/102 X |
| 3,180,220 | 4/1965 | Jefree | 160/378 |
| 3,414,994 | 12/1968 | Jaccard et al. | 38/102.91 |
| 3,950,869 | 4/1976 | Samarin | 38/102.91 |
| 4,409,749 | 10/1983 | Hamu | 160/378 X |
| 4,430,815 | 2/1984 | Wulc | 38/102.91 |
| 4,483,323 | 11/1984 | Murphy | 38/102.2 X |
| 4,571,864 | 2/1986 | Bopp | 38/102.9 X |
| 4,831,753 | 5/1989 | Inteso | 112/103 X |

FOREIGN PATENT DOCUMENTS

| | | | |
|---|---|---|---|
| 0467807 | 6/1947 | Canada | 38/140 |
| 0581036 | 8/1958 | Italy | 38/102.1 |
| 0383745 | 1/1965 | Switzerland . | |

*Primary Examiner*—Werner H. Schroeder
*Assistant Examiner*—Ismael Izaguirre
*Attorney, Agent, or Firm*—McGlew & Tuttle

[57] ABSTRACT

A device for zone-by-zone tensioning of a flat material, especially an embroidery hoop. According to one possible solution, tensioning and clamping are brought about by a change in the circumferential length of a tensioning member that can be filled, by a gas or a fluid and another solution brings this about by twisting a tensioning member. To generate a strong tensioning force in the material, it is proposed in the first solution that the tensioning member be designed as a crease-free tube with a body. By selecting a cord angle of the body, tensioning can be achieved by increasing or decreasing the pressure and by increasing or decreasing the circumferential length. According to another solution, the tensioning member is designed as a torsion body that can be twisted in itself, preferably as a reinforced hollow body, which may also form a closed ring. To increase the tensioning force without unduly stressing the material, the device is designed with a rigid outer ring and a twistable inner ring. By providing the tube that can be filled by a gas or a fluid with strength-ensuring members of limited extensibility in certain areas according to the first possible solution, twisting in this tube can also be achieved for tensioning, as a result of a change of the filling pressure.

24 Claims, 6 Drawing Sheets

INFLATABLE OR TWISTABLE TUBES FOR EMBROIDERY HOOP FABRIC TENSIONING

CROSS REFERENCES TO RELATED APPLICATIONS

This application claims the priority of German applications P3813016.5 filed Apr. 19, 1988 and P3843000.2 filed Dec. 21, 1988 and International application No. PCT/EP89/00415 filed Apr. 18, 1989, the contents of which are incorporated herein by reference.

BACKGROUND OF THE INVENTION

1. Field of the Invention

The present invention pertains to a device for zone-by-zone tensioning of a flaccid, flat material, and especially to an embroidery hoop for textiles.

2. Description of the Related Art

It is known that such a device can be equipped with an annular tensioner that has a member that can be filled by a gas or fluid and which tensions and clamps the flaccid material by increasing its diameter. In particular, it is known that the diameter of the member that can be filled by a gas or fluid is increased by increasing the pressure, thus tensioning the flaccid material, and clamping it relative to a rigid hoop arranged on the outside. It is also known that such a device can be equipped with two rings, one of which can be filled by a gas or fluid or has a member that can be filled by a gas or fluid (see Japanese publication JP-AS Sho-54-23632).

Embroidery hoops have become known which consists essentially of two circular, concentric assembly groups, the inner one of which is formed by a circular bellows with a support ring arranged in it, while the outer one is formed by another circular ring, whose internal diameter is slightly larger than the external diameter of the nonfilled bellows. The edge of the zone to be tensioned is pulled through the circular gap thus formed. Pumping up the bellows increases its external diameter, as a result of which the edge of the material is clamped against the outer ring. Such devices facilitate automation by performing the operations for clamping the textile material, which were previously necessary, by means of a computer-controlled pneumatic system (see Japanese publication JP-AS- Sho-54-23633).

However, the state of the art known from these documents has the disadvantage that the material cannot be pulled tightly enough and that it must be tensioned even prior to clamping.

Fabricating the ring-shaped bellows takes a disadvantageously great amount of effort. Along with the low lot numbers to be produced, it makes them very expensive. In addition, users complain that the tensioned material is still too loose for embroidering.

An embroidery hoop for zone-by-zone tensioning of a flaccid, flat textile material, which is known from U.S. Pat. No. 1,524,732, has a tensioning member which can be placed on the material and is designed as a comb of oval cross section equipped with needles on the lower side, which comb is wedged with locking barbs on the inside of a hoop part, thus being held in its position extending upward from the hoop part.

This also results in it being impossible to simultaneously tension the material to be embroidered on the long sides and the transverse sides, because the combs on the long sides are located outside the available width of passage for the material to be embroidered, so that all-around clamping of the material to be embroidered is ruled out.

Concerning the function of the needle-equipped comb, it is explained in U.S. Pat. No. 1,524,732 that the needles are provided for catching the material to be embroidered, and that when the comb is introduced under the ends of the locking barbs, the material to be embroidered, when held in the same way on the opposite side, tends—due to the oval shape of the comb—to bring about a movement of the comb toward the opposite side of the hoop, as a result of which the locking barbs are locked in their supports. A separate drive for rotating the comb or combs is not provided.

Concerning the function, it is also explained that when the material to be embroidered passes through the space between the top side of the hoop and the lower part of the comb, the comb tends to rotate, and that rotation ends when the needles touch the top side of the hoop. The needles now penetrate the material to be embroidered, thus damaging it.

The rotation takes place during a pull on the material to be embroidered, which pull is directed away from the comb, to tension the material. However, the pulling movement directed away from the comb detaches the comb arranged on the opposite side from the material to be embroidered, so that the material to be embroidered must be constantly kept under tension to tension it and to keep it tensioned. This pulling force must be exerted when the material to be embroidered is moved, corresponding to the embroidery pattern, together with the hoop under the embroidering tools.

When two opposite combs are used, the pulling force on the material to be embroidered must always be directed away from the combs in order to rotate the combs and consequently to cause the needles to penetrate into the material to be embroidered, as a result of which the material to be embroidered would be pulled toward the center of the hoop and a so-called slack would form, so that the opposite of tensioning would be achieved.

SUMMARY OF THE INVENTION

It is an object of the present invention to provide a more inexpensive tensioning device, to tension the material to be processed more tightly, and to maintain it in this state.

Based on this task set, three possible solutions are proposed, which are based on the inventive idea common to the invention. The inventive idea being to completely separate the function of generating a clamping force between the device and the flat material to be embroidered and tensioned, from the second function of this device, namely the tensioning of the flat material to be embroidered. This separation is not realized in any of the prior-art devices. The embodiments of the present invention share the feature that the clamping force can be adjusted by the clamping-down force without changing the tensioning force. Furthermore, all embodiments of the invention share the common feature that a second drive source is present, via which the state of tensioning, i.e., the tightness of the flat material to be embroidered, can be adjusted. This drive can be a pneumatic drive or a mechanical drive, and especially a drive provided with one or several torsion levers.

According to one of the solutions proposed, where the tensioning member placed on the material lying on an abutment tensions the flaccid material due to an increase in its diameter, the task is accomplished according to the present invention by designing the tensioning member as a crease-free tube with a bias-belted body and by altering it under the effect of force in that movement components arise which are directed toward the edge of the area on which the material is placed and which tension the material pressed against the abutment by frictional connection between the tensioning member and the abutment. Especially when the tube increases its diameter due to an increase in the filling pressure and tensions the flaccid material and clamps it against a rigid ring arranged on the outside as a result. It is proposed as a second possible solution that the tube be designed with a radial body without belt plies. Such a body requires only a strength-ensuring layer which encloses an angle of at least 80° with the circumferential direction. According to the second solution proposed, the task is accomplished in that the ring which can be filled by a gas or fluid, or is equipped with a member than can be filled by a gas or fluid reduces its circumference due to a change in the filling pressure thus tensioning and clamping the flaccid material. This member is designed as a crease-free tube with a bias-belted body.

The geometric shape of the member that can be filled by a gas or fluid is considerably simplified by the absence of creases compared with the prior-art bellows. Even though the variation in circumference that can thus be achieved and consequently the possible tensioning travel are smaller than in the case of the prior-art bellows, this is not a disadvantage according to a discovery on which the present invention is based, because what is lacking in bellows is the tensioning force rather than tensioning travel. The present invention is also based on the discovery that tightening consists of two components, namely, tensioning, i.e., stretching, on the one hand, and clamping (fixing), on the other hand. The hitherto unsatisfactory clamping is improved by increasing the possible contact pressure, and this increase is achieved due to the very great filling pressure differences permissible between the loose and clamped state. As a consequence of the simplified shape and the incorporation of a body made of strength-ensuring materials with high tensile strength, filling pressure differences of up to ca. 15 bar are manageable, and light weight construction is achieved at the same time.

The member that can be filled by a gas or fluid, the central component of the tensioning device, is similar, due to the characteristics according to the present invention, to a tube tire for bicycles. It is possible to use the same manufacturing devices, as a result of which a price calculation similar to that of a product manufactured in large series is possible.

Any gas and liquid which does not chemically attack the interior of the tube may be used to fill the tube. Particularly simple handling is achieved if air is used as the filling medium.

The highest contact pressures are reached in the case of a design in which the circumference of the tube increases due to an increase in the filling pressure, and the strength-ensuring layers of the bias-belted body have cord angles of between 60° and 80° relative to the circumferential direction.

It is also possible to reduce the circumference of the tube by increasing the filling pressure, which is achieved with the strength-ensuring layers of the bias-belted body having cord angles of between 10° and 45° relative to the circumferential direction. As a result, a strong clamping force is distributed over a particularly flexible surface, which is recommended for inhomogeneous materials. In addition, tubes which tension the material, reducing their circumference, are particularly readily accessible from the outside.

Occasional malfunctions in compressed air supply are unavoidable in large compressed air supply networks. To prevent such malfunctions from leading to insufficient tensioning, it is proposed according to an improved variant of the inventive solution that the tube tensions and clamps the material as a result of a reduction of the filling pressure. If the tube increases its circumference to achieve this, the strength-ensuring layers of the bias-belted body shall have cord angles of between 10° and 45° relative to the circumferential direction, and if the tube reduces its circumference for tensioning, the strength-ensuring layers of the bias-belted body shall have cord angles of between 60° and 80° relative to the circumferential direction. These variants of the present invention are of interest particularly for processing delicate, expensive materials, e.g., for embroidering silk. In case of a malfunction in the compressed air network, the tensioning device can no longer be released, and no material can be introduced into it. Consequently, no rejects due to insufficient tension can be produced at all.

In a device whose tube increases its circumference to tension the material, and in which the tensioner interacts with a rigid component, the rigid component and the tensioner preferably form a flute, within which the tube operates. If the increase in circumference is achieved by increasing the filling pressure, the flute is preferably designed such that it will first expand radially to the outside from the tube position seen when the material is not yet tensioned, after which it will narrow in the tube position which occurs when the material is tensioned, and the transition is preferably discontinuous. The initial expansion of the flute facilitates the tensioning movement, and the final narrowing of the flute increases the contact pressures during clamping.

If the increase in diameter is brought about by reducing the filling pressure, the flute is advantageously designed such that starting from the tube position that occurs when the material is not yet tensioned, it will first slightly narrow in the radial direction to the outside, after which is will greatly narrow in the tube position in which the material is tensioned, and the transition is preferably discontinuous. The same advantages are achieved with a device that tensions the material by reducing its diameter due to the face that the ring that cannot be filled by a gas or fluid or is not equipped with a member that can be filled by a gas or fluid is designed essentially conically in the area in which it interacts with the ring that can be filled by a gas or fluid or is equipped with a member that can be filled by a gas or fluid in a tensioning manner, wherein the tip of the cone points away from the material to be tensioned, and due to the fact that the control surface of the ring that cannot be filled by a gas or fluid or is not equipped with a member that can be filled by a gas or fluid is limited radially on the inside by a collar-shaped stop.

In a tensioning device whose tube increases its circumference for tensioning, the rigid component according to a preferred embodiment is a flat working plate. This embodiment shows its advantages best in applications in which the actual processing of the tensioned zone of material does not take long, but the zone that is to be tensioned changes in rapid succession. The material feed is particularly easy on a flat plate. This design is also recommended for processing materials which could undergo permanent deformation, e.g., for punching paper or metal foils.

On the flank which comes into contact with the material to be clamped, the tube of a device according to the present invention is advantageously designed as a wear-resistant and profile-less flank with a Shore hardness of between 25 and 50. At this low hardness, which leads to a particularly high coefficient of friction against textiles, high wear resistance is achieved with rubber compounds based on chloroprene and/or butadiene and/or isoprene rubbers with reinforcing fillers. Exclusively light-colored fillers, especially silicic acids, are preferably used as the reinforcing fillers. Coloration of the material to be tensioned in the tensioning zone is thus ruled out.

While the tube on a tensioning device according to the present invention should be designed as a particularly slip-free tube, the component that cannot be filled or has no member that can be filled by a gas or fluid is preferably smooth on the side facing the material to be tensioned. Good results are obtained with a hardened and polished steel surface. Hard, smooth plastics, e.g., fiber-reinforced polyacryl or polystyrene, can be considered for use for high-speed machines, for which steel is too heavy. Unlike in the prior-art embroidery hoops, in which similarly large frictional force components between the material and the internal ring, on one hand, and between the material and the outer ring, on the other hand, are utilized, it is consequently taught here that essentially only one of these two frictional components is used. Restriction to the friction force between the tube and the material makes it possible to overcome the previous problems linked with the fact that a high pressure occurring already at the beginning of tensioning prevented the tensioning movement as a consequence of the resulting friction, while a the low pressure occurring at the beginning permitted the material to slip through even at low tensions, so that parts of the kinematically possible tensioning travel were left unused. Dispensing with one of the frictional force components is compensated for by the remaining frictional force component, and for increasing, it is possible to use the increased normal force as a consequence of increased pressure difference, which can be utilized based on the incorporation of a bias-belted body, and the increased coefficient of friction of the particularly soft flank makes a contribution as well.

According to the third possible solution, the task is accomplished by measures including a tensioning member which can be placed onto the material wherein the tensioning member is designed as a torsion body which can be twisted in itself, the twisting movement having components directed toward the edge of the material in the area in which it is to be placed onto the material for tensioning.

The zone of material to be tensioned and clamped is both pressed by the tensioning member against the support surface of the processing machine and is tensioned to a flat state and firmly held in the tensioned state during displacement on the support surface.

In an embodiment wherein the tensioning member is designed as a torsion body as described above, the tensioning member is composed of twisting bodies connected in a polygon-like manner each twisting body being firmly connected to a tensioning lever extending in its cross section plane, the smaller the arc length of the twisting body, the lower are the requirements to be imposed on the twisting body concerning torsional rigidity.

Designing the tensioning member such that the tensioning member is a hollow body firmly connected to at least one tensioning lever extending in its cross section plane, leads to a weight reduction, and it makes it possible to twist the torsion body manually or by means of a driving device.

The measure in which the hollow body or hollow bodies are reinforced by flexible braided metal liners or wire cores serves to improve stability and achieve good recovery.

For certain work, e.g., small or approximately circular embroidery patterns, it is advantageous to design the tensioning member such that it forms a closed ring. In addition, this makes it possible to provide only one lever to generate the twisting torque.

To embroider an elongated embroidery pattern, it is recommended that the device be designed such that when viewed from the top the tensioning member has a circumferential shape deviating from a circular shape, e.g., in the form of a rounded rectangle or an oval or an ellipse. The higher the tensioning force achieved, the greater may the variations in curvature be. However, a change in the direction of the curvature should be avoided in order to prevent folding in the tensioned material. The mass to be accelerated is reduced by adjusting the top view to the outlines to be actually processed. Consequently, the pace of work can be increased.

To clamp particularly smooth or delicate textiles, it is advantageous, for increasing the holding force, to use as the inner ring the tensioning member such that it forms a closed ring in the device with an inner ring and a rigid outer ring with a closed ring forming the inner ring.

The device including a tensioning member formed by two straight twisting bodies which are arranged in parallel to and at spaced locations from one another in a frame and can be rotated in opposite directions, is particularly well suited for tensioning relatively narrow, elongated pieces of embroidery, such as borders and trimming bands.

Particularly high and uniform tensions are achieved in the material to be processed by providing the tube, on its side facing away from the material to be tensioned, with additional strength-ensuring elements of limited extensibility, which extend essentially in the circumferential direction. The expression "of limited extensibility" means "nonstretchable" for the tubes which tension the material by increasing their circumference and "rigid for pressure" for tubes which bring about tension by a reduction of their circumference. Due to the fact that the circumferential length is prevented from changing on the side facing away from the material to be tensioned, the change in circumferential length is surprisingly increased on the side facing the material to be tensioned.

If the tube increases its circumference under the effect of the filling pressure, the additional strength-ensuring members preferably extend in parallel to each other and approximately in the circumferential direction. In the embodiments in which the tube reduces its circumference under the effect of the filling pressure, the additional strength-ensuring members are preferably arranged in two layers crossing each other, both of which enclose an acute, differently oriented angle with the circumferential direction. Crossing leads to a nonkinking connection. The expression "essentially in the circumferential direction" means that the additional strength-ensuring members enclose angles not exceeding ±30° with the circumferential direction.

The additional strength-ensuring members which are of limited extensibility, which are arranged on the side facing away from the material to be tensioned on an inflatable tube serving as the tensioning member, which lead to the advantageous asymmetric deformation of the tube, are economically applied such that one narrow, annular strip of rubber-coated cord fabric (or a plurality of such strips placed one on top of another) is arranged in the flank in question. The strip(s) can be arranged within and/or between and/or outside the body layer(s).

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1A:
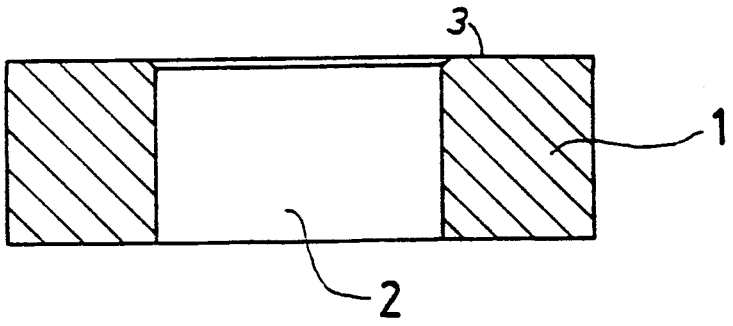
FIGS. 1*a*–1*d* are cross sectional views showing the mode of operation of a pneumatic embroidery hoop whose tube with a bias-belted body increases its circumference by increased filling pressure, thus tensioning the material to be embroidered.
Figure 1B:
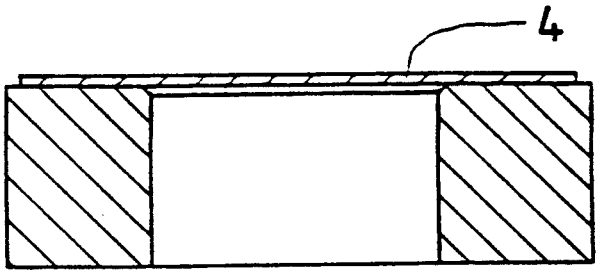
Figure 1C:
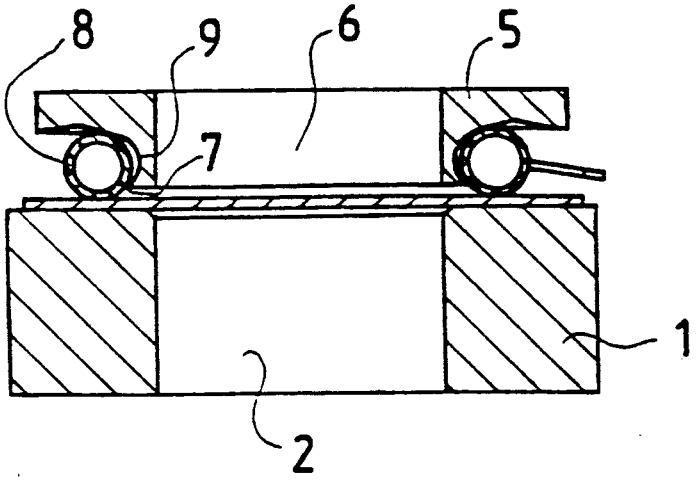
Figure 1D:
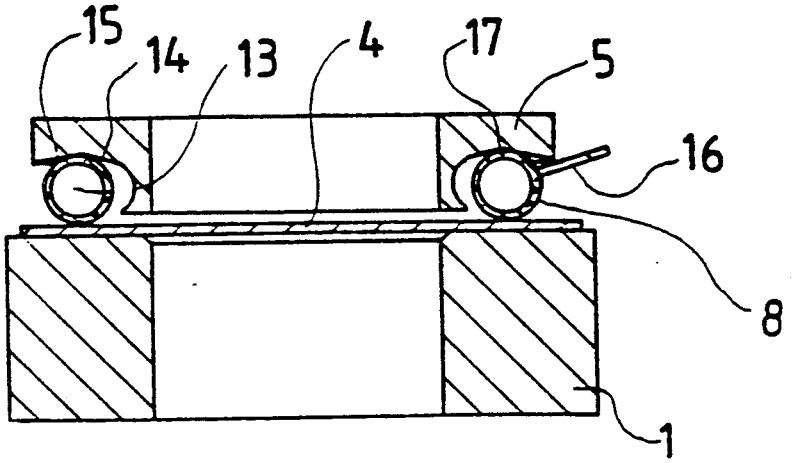

FIG. 1*a* shows a rigid component 1, i.e., a component that cannot be filled by a gas or fluid, having an opening 2 which permits access to the zone of the material web to be embroidered. The rigid component preferably consists of heat-treatable steel. The upper surface 3, on which the material web 4 to be embroidered is placed, as is shown in FIG. 1*b*, is hardened and polished. In FIG. 1*c*, the tensioner 5 has been lowered onto the material web 4. The tensioner 5 has an opening 6 whose shape and function are analogous to those of the opening 2 of the rigid component 1. On its lower side, the tensioner 5 has a collar 7, which absorbs the intrinsic weight of the tensioning tube 8 in the nontensioned state, so that the tube 8 does not fall out of the groove 9 of the tensioner 5 in the downward direction when the tensioner 5 has been raised, i.e., for example, during the change of fabric. The important bias-belted body 11 with its strength-ensuring layers 12 is not shown here for clarity's sake. The tube design is shown separately in FIG. 4.

Together with the rigid component 1, the tensioner 5 forms a flute 13, in which the tube 8 operates. The top side of the flute 13 is subdivided into the surfaces 14 and 15, wherein the tube 8 is supported at the top by the surface 14 at the beginning of tensioning, and is supported by the surface 15 in the tensioned state. The increase in the length of the circumference of the tube 8 during tensioning is supported by the expansion of the flute 13 in the radial direction to the outside in the area of the conical surface 14. However, the narrowing of the flute in the area of the surface 15, where the tube is first supported after it has been pumped to high pressure via valve 16, prevents a further increase in the length of the circumference. The narrowing of the flute also prevents the further increase in the volume of the tube 8 above the filling pressure, and as a result, it allows the pressing force to increase particularly greatly above the filling pressure during the last phase of tensioning. Due to this subdivision, an unnecessarily strong pressing fore and an unnecessarily great friction are avoided during tensioning, on one hand, and, on the other hand, particularly strong clamping is achieved at the end of the tensioning movement, so that the material 4 will not loosen even during subsequent rough handling, especially during high-speed embroidering.

The transition between the two surfaces 14 and 15 is designed as a kink 17, i.e., it is discontinuous. Besides the favorable effect of the filling pressure on the changes in the pressing force and the changes in the tensioning travel, the tube 8 is centered relative to the tensioner due to the inclination of the surfaces 14 and 15.

As can be recognized from the changing position of the valve 16, the tube 8 is twisted, because its friction against the surface 14 is greater than the friction of the material web 4 against the smooth surface 3 of the flat working plate 1. The best tensioning results are obtained when the tube cross section rolls on the surface 14 without slip.

FIGS. 2*a* through 2*d* show a similar pneumatic embroidery hoop. However, the tensioner 5, to which the tensioning tube 8 belongs, is located at the bottom. The tube 8 lies on the tensioner 5 rather than being suspended under it, so that no means for absorbing the intrinsic weight of the tube 8 are required here. A simple port is provided as the compressed air connection 16 in this example. The valve for controlling the admission and removal of air is arranged in the periphery of the embroidery hoop (not increasing its diameter. In particular, it is known „that the shown).

On its lower side 18, the tube 8 has a strip 19, containing 15 strength-ensuring members, which prevents the stretching movement. This prevention surprisingly leads to improved tension in the material 4. Besides the adjustment of the coefficients of friction as shown in the preceding embodiment, the asymmetric prevention of stretching shown here also leads to an advantageous twisting of the tube 8, as can be recognized from the position of the compressed air connection 16. The embedded nonstretchable strength-ensuring members 20 are shown, for clarity's sake, in FIG. 4*b* rather than a detailed showing in the sequence of FIGS. 2*a*–2*d*, which show the function. Twisting of the tube is achieved in a particularly reliable and readily reproducible manner due to the nonstretchable strength-ensuring members arranged between the plies of the body on the side facing away from the material web.

Figure 2A:
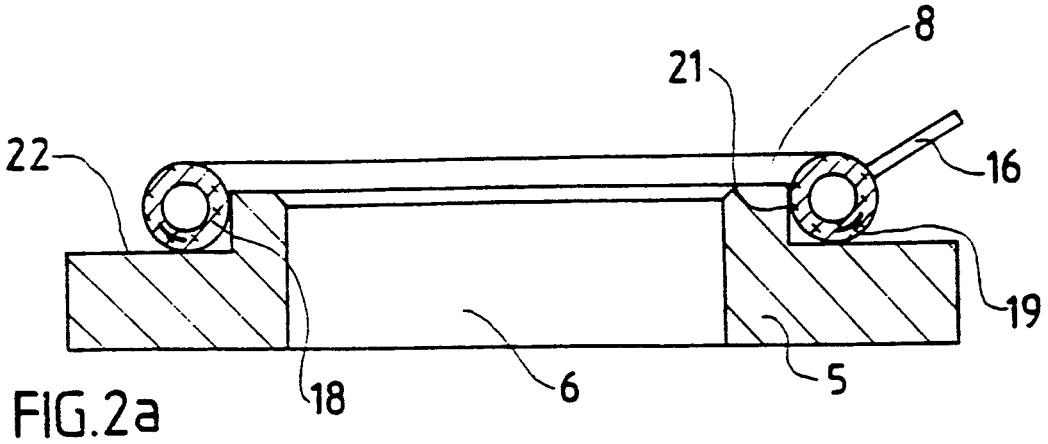
FIGS. 2*a*–2*d* are cross sectional views showing the mode of operation of a similar embroidery hoop, but with the tube arranged outside the material to be embroidered, which tube is prevented at its lower side from stretching.

FIG. 2*a* shows the tensioner 5 with its processing opening 6 and the associated tensioning tube 8, which is centered at the stop 21 in the nonstretched state. The surface 22, on which the tube 8 is supported, is flat.

Figure 2B:
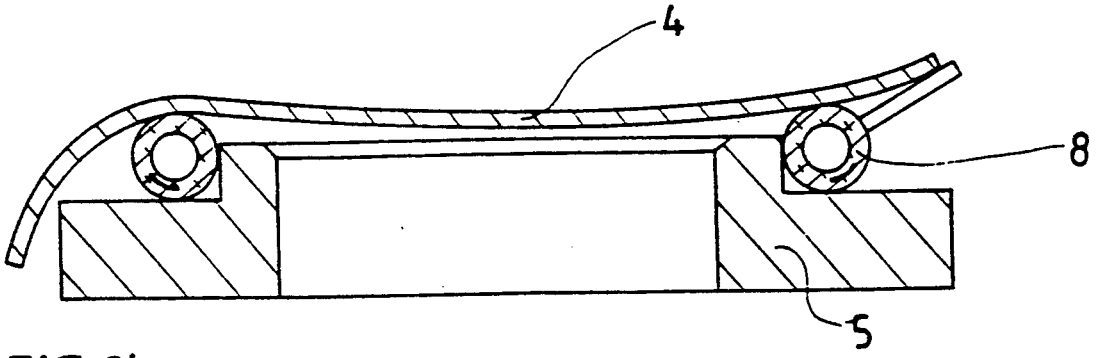

In FIG. 2*b*, the material web 4 is pulled over the tensioner 5 with its tube 8.

Figure 2C:
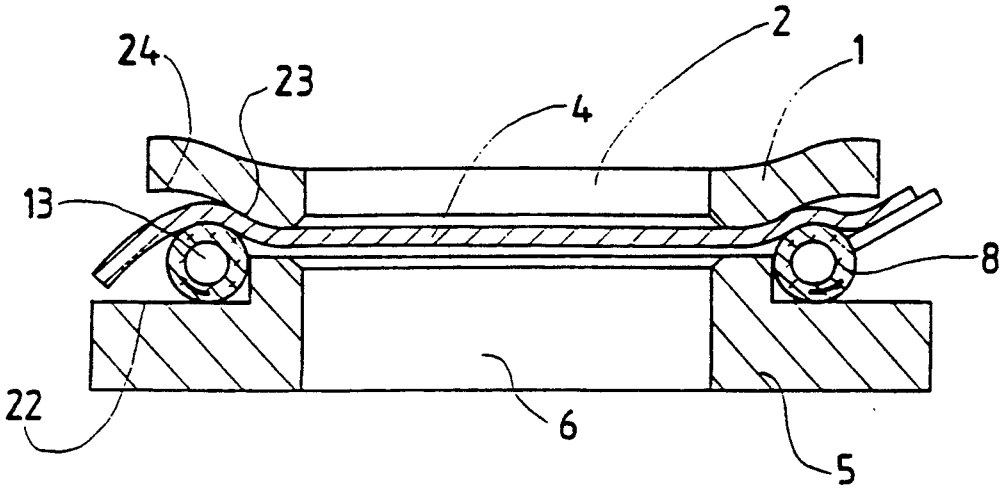

In FIG. 2*c*, the rigid component 1, i.e., a component that cannot be filled by a gas or fluid, is lowered onto the material web 4. The rigid component 1 has an opening 2 whose shape and function are analogous to those of the opening 6 of the tensioner 5. Contrary to the first embodiment, the rigid component is not flat, but is bent upward cf. surface 23 above the position which the tube 8 assumes in the nonstretched state FIG. 2*c* and is again flat or bent slightly down cf. surface 24 above the position which the tube 8 assumes in the stretched state FIG. 2*d*. Consequently, together with the flat surface 22 of the tensioner 5, a flute 13, in which the tube 8 operates, and which is similar to that in FIG. 1, is formed here.

Figure 2D:
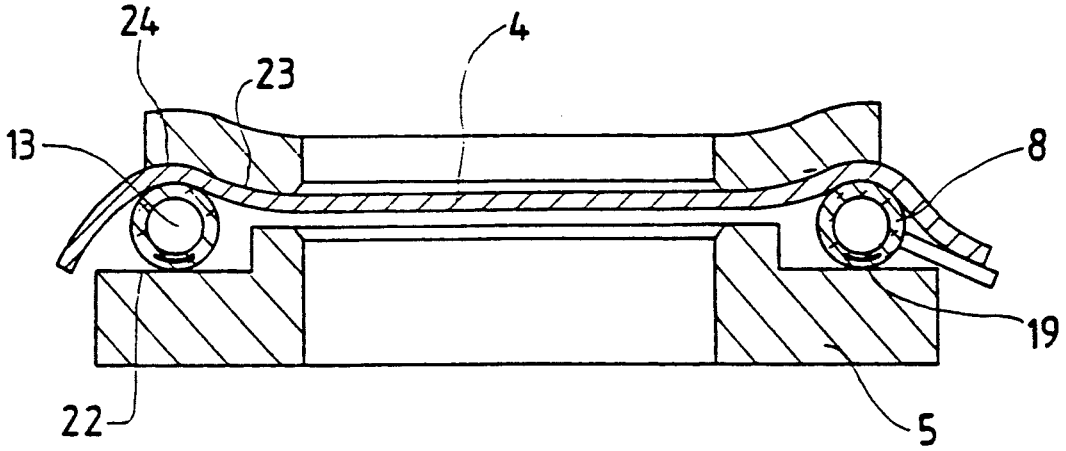
Figure 3A:
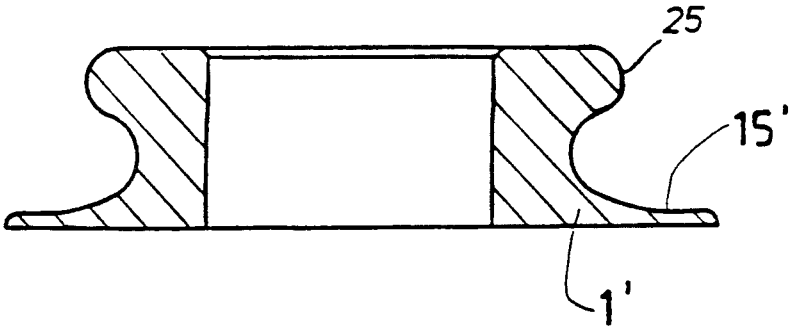
FIGS. 3*a*–3*d* are cross sectional views showing the mode of operation of a pneumatic embroidery hoop, whose tube with bias-belted body reduces its circumference upon a reduction of the filling pressure, thus tensioning the material to be embroidered.
Figure 3B:
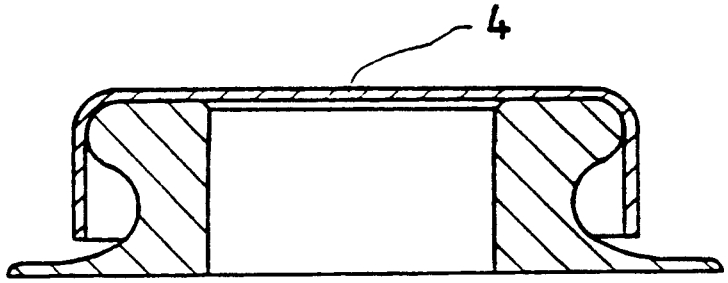
Figure 3C:
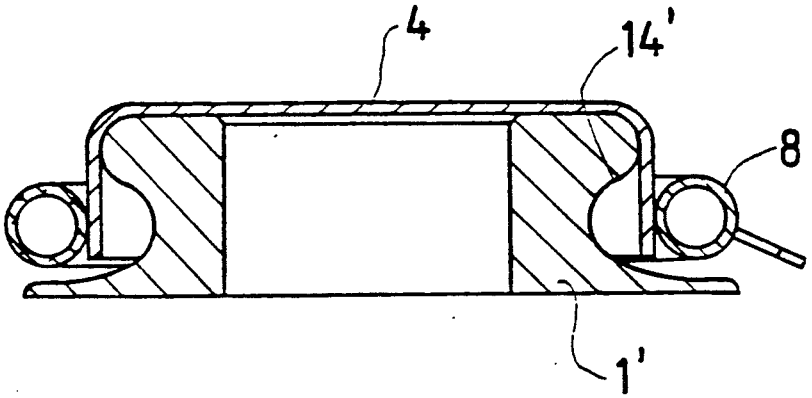
Figure 3D:
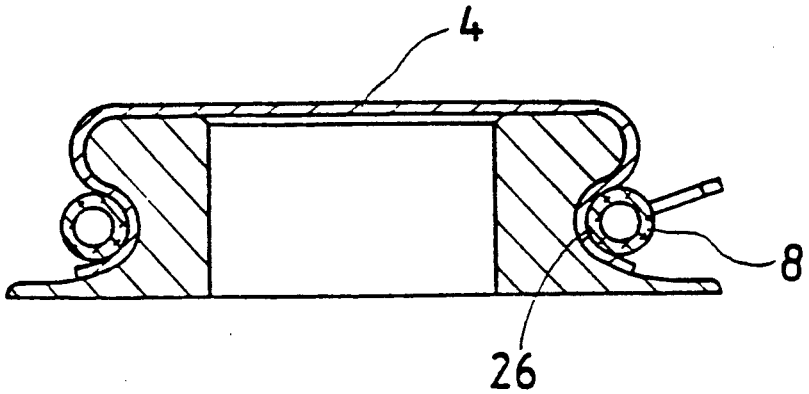

FIG. 2*d* shows the embroidery hoop in the tensioned state. The tube 8 is supported by the surface 22 of the tensioner 5. Maximum twisting of the tube is achieved due to the arrangement in which the mean perpendicular passing through the strip 19 of additional strength-ensuring members is exactly perpendicular in the tensioned state to the resulting frictional force tensioning the material 4.

The sequence of FIGS. 3*a*–3*d* shows the mode of operation of a pneumatic embroidery hoop, whose tensioning tube 8 tensions the material web 4 due to a reduction of its circumferential length. To deflect the force, the rigid component 1, has a horn 25, so that together with the stop 15', it is similar to a wheel rim. At the beginning of tensioning, the tube 8 comes to lie against the zone 14' of the rigid component 1', which is essentially conical, and the tip of the cone points away from the material 4 to be tensioned.

Due to the tensioning force of the tube being applied essentially from the inside 26 of the tube onto the material web 4 in this arrangement, the tube 8 is particularly easily accessible from the outside. This facilitates handling and checking. Contrary to the above-mentioned two embodiments, the tube 8 is not a component of a tensioner here, but is applied manually, thus reducing the purchase price of a device according to the present invention. Aside from the deviations specific to the principle, all the previously mentioned aspects of the technical teaching can be applied analogously here, and thus they will not be repeated here.

Figure 4A:
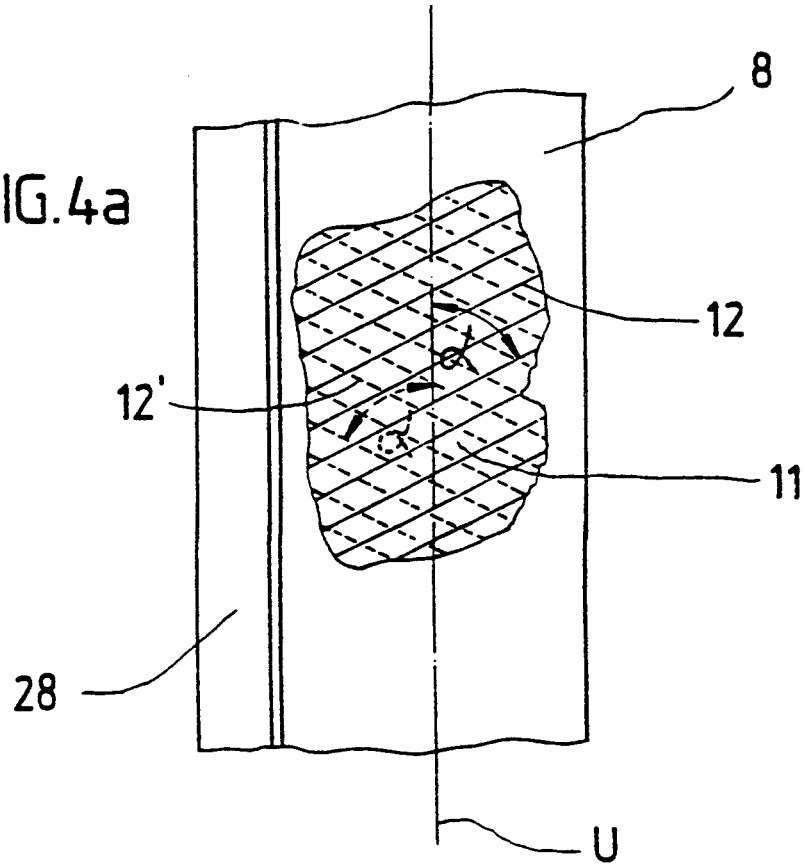
FIG. 4*a* is a partially cut-away side view of a tube for a pneumatic embroidery hoop according to the invention.
Figure 4B:
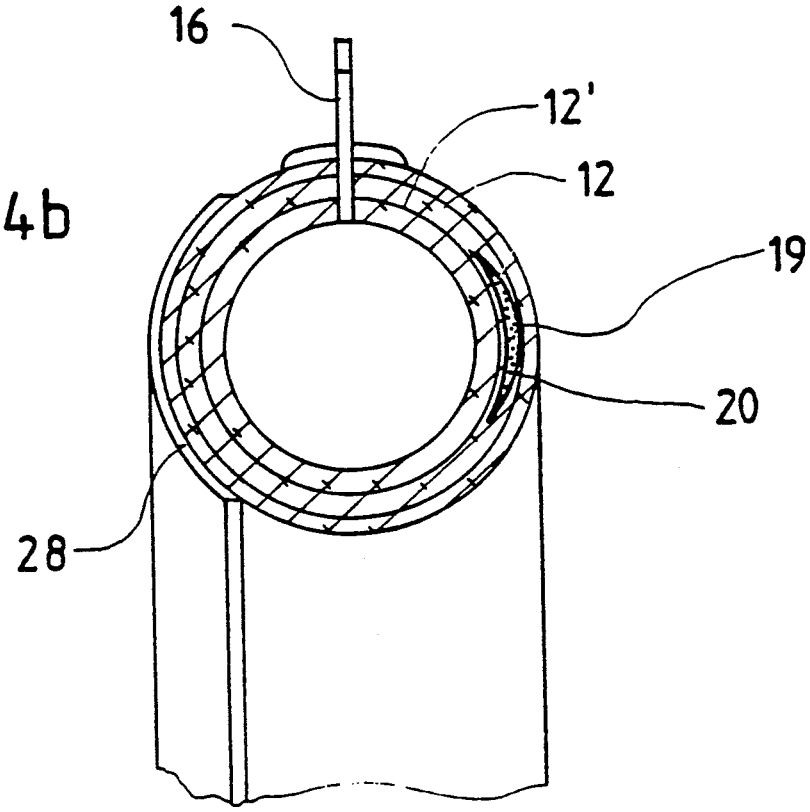
FIG. 4*b* is a cross sectional view of the tube for a pneumatic embroidery hoop of FIG. 4*a;*

FIG. 4 shows the design of a tensioning tube 8 for a device according to the present invention; specifically, FIG. 4*a* shows a partially cut-away side view and FIG. 4*b* shows a cross section. The tube 8 shows a bias belted body 11, which consists of two layers 12, 12' of parallel strength-ensuring members. Both strength-ensuring layers 12, 12' enclose the same alpha angle 63° with the circumferential direction (U), which is indicated by a dash-dotted line, but with opposite orientations. The tube shown increases its circumference on increasing the filling pressure and reduces its circumference on reducing the filling pressure.

On its right-hand side between the two body plies, the tube 8 has a strip 19, in which nonstretchable strength-ensuring members 20 are embedded. On the other side, on which the material to be tensioned is to come into contact, a rubber strip 28, which is characterized by particular softness along with high abrasion resistance, is arranged on the outside. Contrary to the other areas of the tube, the flank strip 28 contains no carbon black as a reinforcing filler. The tube is filled via the valve 16.

Both the cross sectional shape and the design of the tensioning tubes proposed differ greatly from the prior-art annular bellows and permit substantially greater pressure differences between the tensioned and released states to be utilized. They are the most important component of the tensioning devices according to the present invention. Due to special design of the flute of the tensioning devices, in which the tensioning tubes operate, the adjustment of the coefficient of friction to the different parts of the tensioning device, and asymmetric prevention of stretching and shrinking, the properties of the tensioning tubes are realized in a particularly advantageous manner.

FIGS. 5 through 8 show embodiments of the device according to the present invention in which the tensioning member is operated by torques imposed from the outside rather than by a change in the internal pressure.

Figure 5:
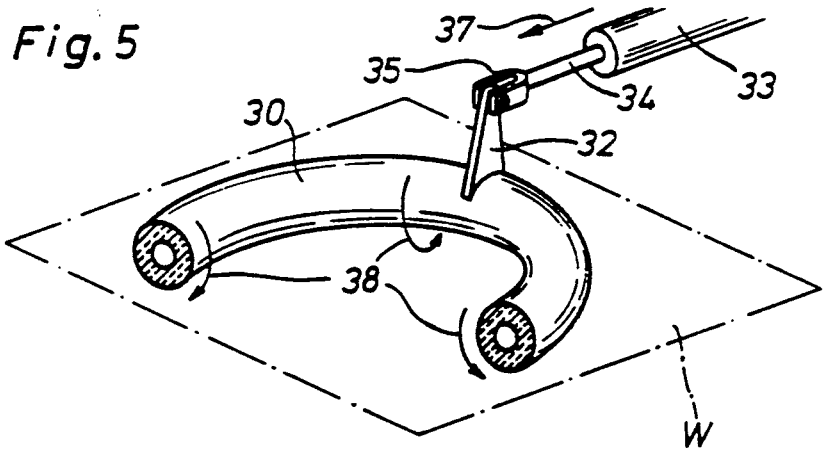
FIG. 5 is a schematic partial perspective view of a tensioning member designed as a twisting body.
Figure 6:
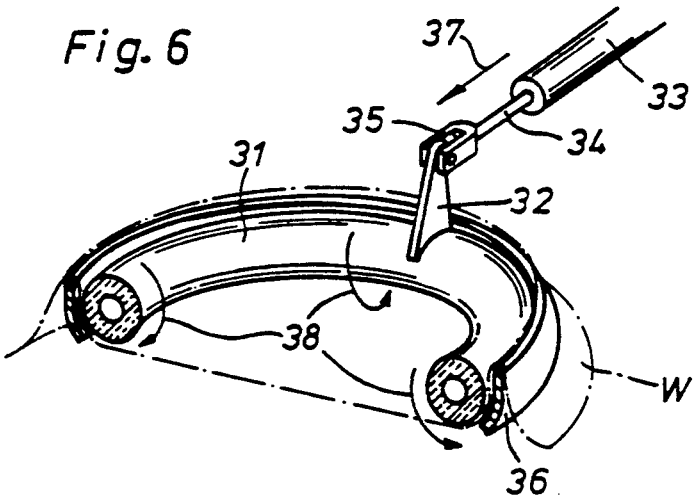
FIG. 6 is a schematic partial perspective view of a device with a rigid outer ring and an inner ring that can be twisted in itself.

The torsion body 30 in FIG. 5 and 31 in FIG. 6, which forms the tensioning member, consists of a material with a high coefficient of friction and is designed as a tube-shaped hollow body and closed ring in FIGS. 5 and 6. It is advantageous for many applications to design the torsion body 30 or 31 with an outline deviating from the circular shape in the top view, e.g., in the form of a rounded rectangle, an oval, or an ellipse. It may be reinforced with a flexible braided metal liner or wire core and is firmly connected to a tensioning lever 32, which extends radially relative to the cross section surface of the torsion body 30 or 31. To twist the torsion body 30, 31, a double-acting pneumatic cylinder 33 is provided, whose piston rod 34 connected to its working piston is hinged to the free end of the tensioning lever 32 via a yoke 35. The rigid component 1 or 1' cooperating with the torsion body 30 and the tensioner 5 have been omitted. Free mobility of the tensioning lever 32 must, of course, be ensured for practical use by providing corresponding recesses at the tensioner 5 or at the rigid component 1.

In the embodiment shown in FIG. 6, the device consists of a torsion body 31 forming a closed inner ring and a rigid outer ring 36.

While the tensioning member 30 shown in FIG. 5 is placed directly onto the workpiece W placed on the work table in a non-positive manner and is twisted in itself in the direction of the arrows 38 by displacing the piston rod 34 in the direction of the arrow 37 to tension the area to be embroidered, the material W to be processed must be placed over the outer ring 36 with the inner ring 31 raised and be pressed into the outer ring 36 by lowering the inner ring 31 before the inner ring 31 is twisted in itself in the direction of the arrows 38 by moving the piston ring 34 in the direction of the arrow 37 to tension the area to be embroidered.

Figure 7:
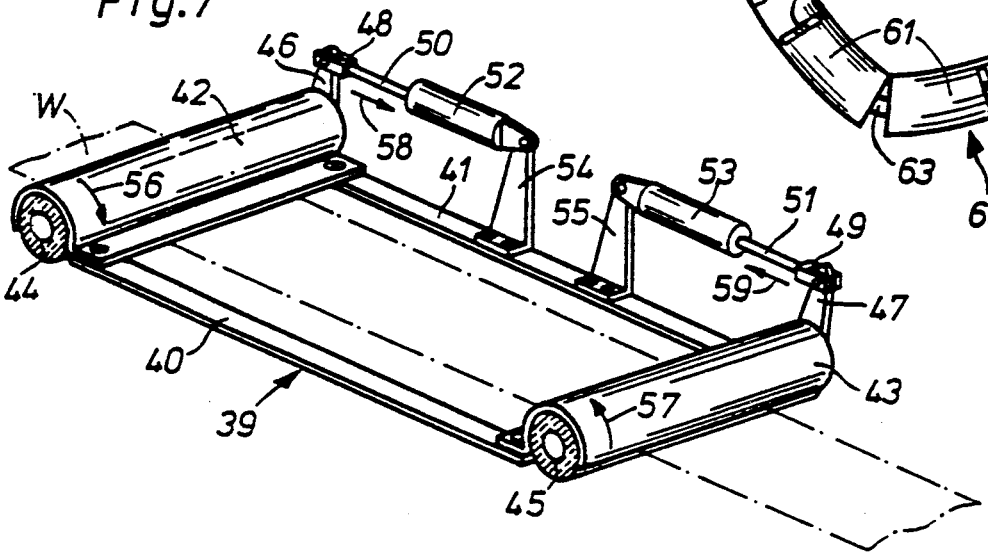
FIG. 7 is a perspective view of an embroidery hoop with two straight twisting bodies serving as tensioning members.

FIG. 7 shows an embodiment of the device for tensioning and clamping narrow, band-shaped materials to be embroidered. The device is designed as a rectangular hoop 39 with two longitudinal bars 40 and 41 and two supports 42 and 43 of semicircular cross section connecting the ends of the longitudinal bars 40 and 41, which are open in the downward direction and in which one straight, reinforced hollow body 44 and 45 each is rotatably mounted as a tensioning member. The hollow bodies 44 and 45 are firmly connected on one front side to a tensioning lever 46 and 47, whose free end is hinged via a yoke 48 or 49 to the piston rod 50 or 51 of double-acting pneumatic cylinders 52 and 53, wherein the piston rod 50 or 51 is connected to the respective working piston.

Two angles 54 and 55 are attached to the longitudinal bar 41. The housing of the pneumatic cylinder 52 is hinged to the free end of the angle 54 and the housing of the pneumatic cylinder 53 is hinged to the free end of the angle 55.

As in the embodiment shown in FIG. 5, the device according to FIG. 7 can be placed with the tensioning members 44 and 45 directly onto the workpiece W laid out on the support surface of a processing machine in a non-positive manner. To tension and clamp the workpiece W, the tensioning members 44 and 45 are subsequently rotated in opposite directions indicated by the arrows 56 and 57 by moving the piston rod 50 and 51 in the direction of the arrow 58 or 59 by admitting air into the pneumatic cylinder 52. This movement is transmitted via the yoke 48 or 49 and the tensioning lever 46 or 47 to the tensioning members 44 and 45, which are now rotated in the direction of arrow 56 or 57, thus tensioning and clamping the area of the workpiece W to be embroidered.

Figure 8:
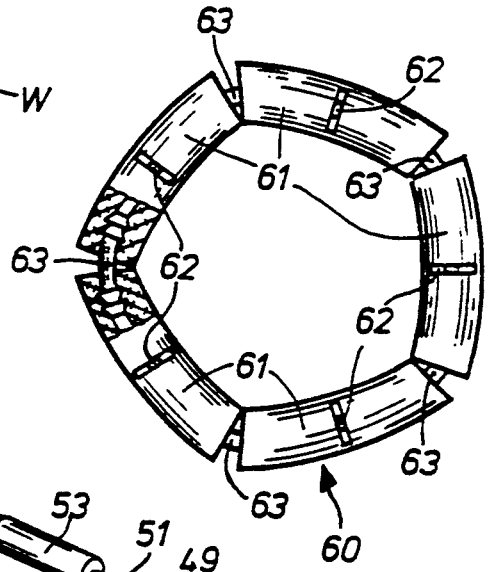
FIG. 8 is a top view, partially in section showing a tensioning member composed of a plurality of twisting bodies in a polygon-like manner.

Finally, FIG. 8 shows a tensioning member 60 intended for workpieces of special form, which is composed in this embodiment of five twisting bodies 61 in a polygon-like manner, on whose torsional rigidity relatively low requirements are imposed because of their short arc length. Each twisting body 61 is firmly connected to a tensioning lever 62 that extends in its cross section plane and can be operated manually or by a driving device. The twisting bodies 61 are connected to each other by coupling pieces 63.

While specific embodiments of the invention have been shown and described in detail to illustrate the application of the principles of the invention, it will be understood that the invention may be embodied otherwise without departing from such principles.

We claim:

1. A device for the zone-by-zone tensioning of a flaccid, flat material for an embroidery hoop for textiles, comprising an abutment; and tensioning member for pressing against the abutment for clamping the material in an edge area, said tensioning member including a crease-free tube with a bias-belted body of which a circumference is increasable by an effect of changing internal filling pressure to generate moving components, directed toward the edge area, whereon the tensioning member is placed to tension the material by frictional connection between the tensioning member and the material pressed against the abutment.

2. A device according to claim 1, wherein said crease-free tube increases in circumference upon an increase in the filling pressure, said bias-belted body including strength-ensuring layer elements enclosing a cord angle ($\alpha$) of between 60° and 80°, with respect to a circumferential direction (U).

3. A device according to claim 2, wherein said tensioning member cooperates with a rigid component, said rigid component and said tensioning member forming a flute, said tube operating within said flute, said flute having a first portion expanding outwardly progressively in a radial direction starting from a tube rest position corresponding to a position of the tube when the material is not yet tensioned, and having a second portion which narrows to a tube engagement position corresponding to a position of the tube occurring when the material is tensioned, and a transition element forming a discontinuity between said first portion and said second portion.

4. A device according to claim 1, wherein said tube has an annular shape and includes an overall-all circumference, said tube circumference increasing upon a reduction of the filling pressure, strength-ensuring layers of said bias-belted body enclosing a cord angle ($\alpha$) of between 10° and 45° with respect to a circumferential direction (U).

5. A device according to claim 4, wherein said tensioning member cooperates with a rigid component, said rigid component forming a flute surface, said tube engaging said rigid component along said flute surface, said flute surface including a first portion which narrows radially in in an outward direction beginning from a tube rest position, corresponding to a position of the tube when the material is not yet tensioned and a second portion which narrows in a radially direction to a tube engagement position, corresponding to the tube position that occurs when the material is tensioned, said flute surface including a transition portion between said first portion and said second portion, said transition portion providing a discontinuity between said first portion and said second portion.

6. A device according to claim 1, wherein said rigid component is provided as a flat working plate.

7. A device according to claim 1, wherein said abutment and said tensioning member comprise rings with a circumference, said tensioning member tube being filled by a fluid, a change in filling pressure thereby reducing the circumference of said tensioning member ring for tensioning and clamping the material.

8. A device according to claim 7, wherein said tube includes a circumference defined by material which reduces the circumference due to an increase in filling pressure, said tube including strength-ensuring layers associated with a bias-belted body enclosing a cord angle ($\alpha$) of between 10° and 45° with respect to a circumferential direction (U).

9. A device according to claim 7, wherein said tube has a circumference which is reduced upon reduction of filling pressure, said tube including a bias-belted body with strength-ensuring layers enclosing a cord angle of between 60° and 80° with respect to a circumferential direction (U).

10. A device according to claim 7, wherein said abutment ring includes an outer conical surface with a tip directed outwardly from a central ring and a surface adjacent said tip cooperating with said tensioning member ring for tensioning the material.

11. A device according to claim 7, wherein said abutment ring includes an outer conical surface with an end limited by a radially extending collar-shaped stop.

12. A device for zone-by-zone tensioning of a flaccid, flat material for an embroidery loop for textiles, comprising a tensioning member which is filled with a fluid under changeable pressure, whereby increasing pressure increases circumference of the tensioning member and another member including a rigid ring, said tensioning member tensions the flaccid material upon increasing pressure and clamps said flaccid material against an outside of said rigid ring, said tensioning member including a crease-free tube with a radial body.

13. A device according to claims 1, 7 or 12, wherein said tube is formed as a wear-resistant and profile-less body with a shore hardness of between 25 and 50 at a flank, said flank coming into contact with the material to be clamped.

14. A device according to claims 1, 7, or 12, wherein said tube includes a flank strip formed of a rubber compound, said rubber compound coming into contact with the material to be clamped and containing only light-colored fillers.

15. A device according to one of claims 1, 7 or 12 wherein the abutment member includes a smooth surface on a side facing the material to be tensioned.

16. A device according to one of claims 1, 7, or 12 wherein said tensioning member includes a circumferential shape deviating from a circular shape.

17. A device according to one of claims 1, 7 or 12 wherein said tube includes additional strength-ensuring members of limited extensibility, extending essentially in a circumferential direction (U) on a side facing away from the area of material to be tensioned.

18. A device for zone-by-zone tensioning of flaccid flat material, the device comprising:

an abutment;

tensioning means for pressing the flaccid flat material against said abutment and clamping said flaccid flat material between said tensioning means and said abutment, said tensioning means having a tensioning member with a high frictional coefficient surface pressed against the flat flaccid material, said tensioning means being also for rotating said tensioning member about a longitudinal centerline, in a manner to tension the first flaccid material through frictional connection between said high frictional coefficient surface of said tensioning member and the flat flaccid material.

19. A device according to claim 18, wherein said tensioning member includes a polygonal pattern of twisting bodies, each twisting body having a frictional surface, each of said twisting bodies being rigidly connected to a tensioning lever extending in a cross sectional plane relative to said twisting bodies.

20. A device according to claim 18, wherein said tensioning means includes a hollow body which is rigidly connected to at least one tensioning member, said hollow body including said frictional surface, said tensioning member extending in a cross sectional plane with respect to said hollow body.

21. A device according to claims 18, 19 or 20 wherein each hollow body is reinforced by one of a flexible braided metal liner and a wire core.

22. A device according to claim 18, wherein said tensioning member forms a closed ring.

23. A device according to claim 22, wherein said tensioning member includes an inner ring and an outer rigid ring, said closed ring forming said inner ring.

24. A device according to claim 18, wherein said tensioning member is formed by two straight twisting bodies, positioned in parallel with each other and at spaced locations in a hoop, said twisting bodies being rotatable in opposite directions.

* * * * *